US005524321A

United States Patent [19]

Weaver et al.

[11] Patent Number: 5,524,321

[45] Date of Patent: Jun. 11, 1996

[54] VACUUM CLEANER WITH A DETACHABLE VACUUM MODULE

[75] Inventors: James M. Weaver; Giovanni Pino, both of Grand Rapids; Marc D. Zuiderveen, Kalamazoo; Steven Umbach, East Grand Rapids, all of Mich.

[73] Assignee: Bissell Inc., Grands Rapids, Mich.

[21] Appl. No.: 362,553

[22] PCT Filed: Feb. 14, 1994

[86] PCT No.: PCT/US94/01496

§ 371 Date: Jan. 6, 1995

§ 102(e) Date: Jan. 6, 1995

[87] PCT Pub. No.: WO94/17716

PCT Pub. Date: Aug. 18, 1994

[51] Int. Cl.[6] ..... A47L 5/30; A47L 5/36

[52] U.S. Cl. ..... 15/329; 15/323; 15/327.5; 15/339; 15/410

[58] Field of Search ..... 15/328, 329, 323, 15/327.5, 410, 416

[56] References Cited

U.S. PATENT DOCUMENTS

| | | | |
|---|---|---|---|
| 2,348,861 | 5/1944 | Smellie | 15/416 X |
| 4,318,202 | 3/1982 | Holman | 15/328 |
| 4,665,582 | 5/1987 | Richmond et al. | 15/344 |
| 5,054,157 | 10/1991 | Werner et al. | 15/328 |
| 5,309,600 | 5/1994 | Weaver et al. | 15/329 X |

FOREIGN PATENT DOCUMENTS

| | | | |
|---|---|---|---|
| 648771 | 8/1937 | Germany | 15/328 |

*Primary Examiner*—Chris K. Moore

*Attorney, Agent, or Firm*—Varnum, Riddering, Schmidt & Howlett

[57] ABSTRACT

A multi-use vacuum cleaner capable of use as an upright vacuum or as a detachable vacuum module is disclosed. A detachable vacuum module is selectively mounted to the foot and support member of an upright vacuum cleaner. The vacuum module includes the vacuum motor, motor-driven fan, vacuum bag and hose. The vacuum cleaner may be operated as an upright vacuum, or alternatively, the module can be separated from the foot and support member and may be used independently of and at a great distance from the foot and support member for a wide variety of cleaning purposes.

36 Claims, 8 Drawing Sheets

VACUUM CLEANER WITH A DETACHABLE VACUUM MODULE

BACKGROUND OF THE INVENTION

1. Field of the Invention

This invention relates to a multi-use vacuum cleaner, and, more particularly, to a vacuum cleaner having a vacuum module which is detachably mounted to a power foot and support member.

2. Description of Related Art

Vacuum cleaning machines have typically been one of two different designs, either an upright vacuum cleaner or a canister vacuum cleaner. The upright vacuum cleaner comprises a cleaning foot upon which is pivotally mounted a handle supporting the vacuum motor and bag. Uprights are typically most useful in cleaning floors and carpet.

A canister vacuum usually comprises a canister housing which supports the vacuum motor and bag. A long hose and wand extend from the canister housing. The wand can be attached to a cleaning foot or can be used with tools such as brushes or nozzles for cleaning unusual surfaces such as stairs, upholstery, curtains and automobile interiors.

A recent trend has been to develop multi-use upright vacuum cleaners which combine the compact structure and vertical orientation of an upright vacuum with the extension capabilities of a hose and wand. Such a multi-use machine can be used as an upright vacuum cleaner to clean carpeting or use the extendable hose to clean upholstery, drapery and the like. One example of a multi-use machine is manufactured by Windsor Industries, Inc. of Englewood, Colorado, U.S.A. and sold under the trademark VERSAMATIC EC™. This vacuum comprises a floor engaging foot and an integral upright housing and elongated support member. The upright housing and elongated support member can be separated from the foot for use with a wand or other cleaning attachments. Other examples of similar multi-use machines are disclosed in U.S. Pat. No. 4,955,106 to Stein et al., issued Sep. 11, 1990; U.S. Pat. No. 4,393,536 to Tapp, issued Jul. 19, 1983; U.S. Pat. No. 4,811,452 to Sumerau, issued Mar. 14, 1989; and U.S. Pat. No. 4,519,113 to Hipple, issued May 29, 1985.

Another modification to the basic structure of an upright vacuum cleaner is seen in U.S. Pat. No. 4,545,089 to Oxel, issued Oct. 8, 1985 and U.S. Pat. No. 4,467,493 to Buchtel, issued Aug. 28, 1984. In these references, a small hand-held vacuum is selectively mounted to the body of an upright vacuum.

Each of these several different prior multi-use upright vacuum cleaners suffer from the problem of the ability to use and operate the detachable wand or hand-held vacuum independently of or a significant distance from the body of the upright vacuum cleaner. Moreover, when using the hand-held vacuum independently of the body of the upright vacuum cleaner, it is important to minimize the weight and maximize the compact structure of the hand-held vacuum making it easier to use the hand-held vacuum a significant distance from the body of the upright vacuum cleaner.

SUMMARY OF INVENTION

The multi-use upright vacuum cleaner according to the invention overcomes the problems of the prior art by combining, in a single unit, the desired ease of use, compact configuration and performance of an upright vacuum with the portability and multiple applications of a canister vacuum.

The vacuum cleaner according to the invention comprises a foot housing, a base member pivotally mounted to the foot housing and an elongated support member non-removably mounted at a lower portion thereof to the base during typical use of the vacuum cleaner. The elongated support member is adapted for use in pushing and pulling the base and the foot housing along the floor. The vacuum cleaner further comprises a portable cleaning module having a module housing, a bag supported in the module housing for collecting dust and dirt and a flexible conduit for conveying the collected dust and dirt from the foot housing to the bag. The conduit has a first end connected to the bag and a second end removably connected to the base member. A motor driven fan is supported in the module housing for creating suction within the conduit through the bag to convey the collected dust and dirt to the bag. The module mounts the bag, conduit and motor-driven fan such that the bag, conduit and motor-driven fan are connected together as a unit. The module is selectively and removably mounted to the base member at least through a mechanical interconnection such that the module can be separated from the foot housing, base and elongated support member and be operated as a portable vacuum cleaner. The module is closely adjacent the elongated support member, extends upwardly along at least a portion of the length of the elongated support member and is adapted to pivot with the base and elongated support member relative to the foot housing when the module is mounted to the base. The module can be operated as a portable vacuum cleaner independently of and separate from the foot housing, base and elongated support member when the module is separated from the base. The vacuum cleaner can be operated as an upright vacuum cleaner when the module is mounted to the base.

BRIEF DESCRIPTION OF THE DRAWINGS

The invention will now be described with reference to the drawings wherein.

DESCRIPTION OF THE PREFERRED EMBODIMENTS

Figure 1:
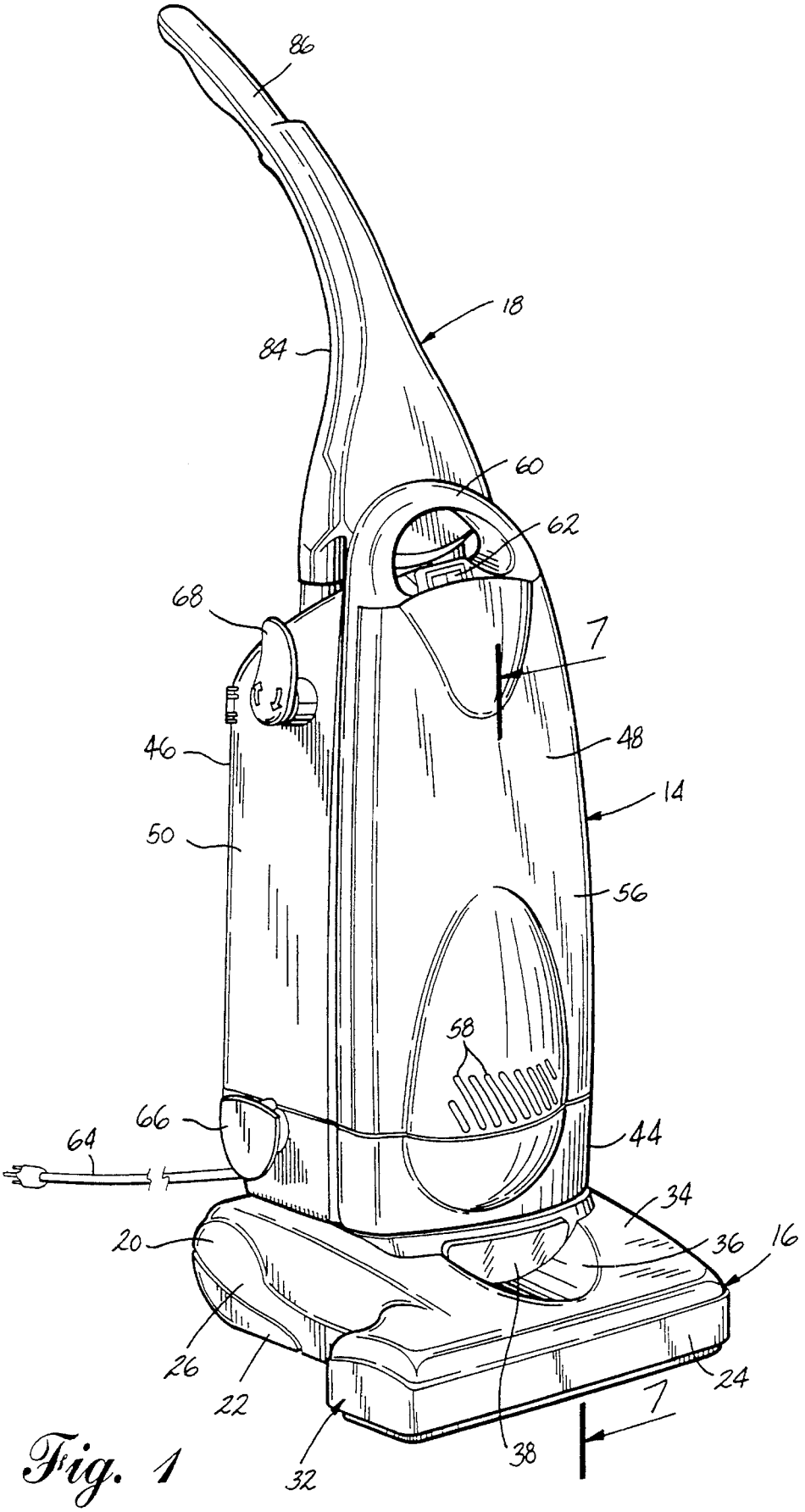
FIG. 1 is a perspective view of the multi-use vacuum cleaner having a detachable vacuum module according to the invention.
Figure 2:
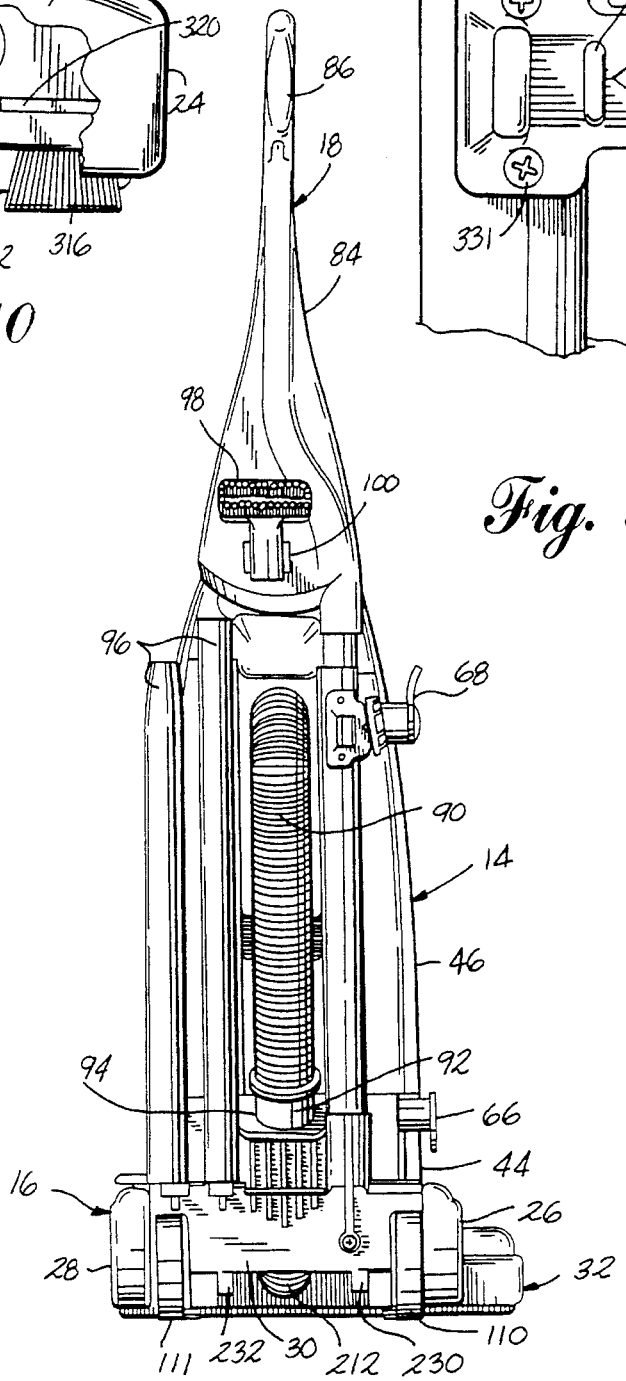
FIG. 2 is a rear elevational view of the multi-use vacuum cleaner of FIG. 1.

Referring now to the drawings, as seen in FIGS. 1 and 2, the multi-use vacuum 12 according to the invention comprises a floor engaging foot housing 16, a module 14 selectively mounted to the foot housing 16 and an elongated support assembly 18 mounted to the foot housing 16.

The foot housing comprises an upper housing member 20 and a lower housing member 22 which define the front wall 24, side walls 26, 28 and rear wall 30 of the foot housing 16. An edge cleaning projection 32 extends laterally outwardly from the side wall 26 of the foot housing. The upper surface 34 of the upper housing member 20 has a depression 36 formed therein which receives a lens 38.

The module 14 comprises a motor housing 44 and a bag housing 46 securely mounted to the top of the motor housing 44. The motor housing 44 and bag housing 46 define the front wall 48, side walls 50, 52 and rear wall 54 of the module 14. An access panel 56 is mounted to the front of the bag housing 46 and plurality of exhaust slots 58 are formed adjacent the bottom edge of the access panel 56. A laterally oriented arcuate handle 60 is formed on the top of the bag housing 46 and a three position electrical switch 62 is mounted to the top of the bag housing 46 immediately adjacent the handle 60. An electrical cord 64 extends outwardly from the motor housing 44 and, as described further below, is adapted to supply all electrical current necessary for operation of the multi-use vacuum as an upright vacuum or as a portable vacuum module. A pair of cord wrap members 66, 68 extend outwardly from the sidewall 50 of the module 14 and are adapted to receive the electrical cord 64 thereon.

The elongated support assembly 18 comprises a tubular support member 82 and a contoured support member 84 securely mounted to the top of the tubular support member 82. The bottom of the tubular support member 82 is securely mounted to the foot housing 16. A grip 86 is formed at the terminal end of the contoured support member 84.

One end of a flexible hose 90 is securely mounted to the upper portion of the rear wall 54 of the module 14. A collar 92 is mounted on the other end of the flexible hose 90 and the collar is selectively received in an integrally molded conduit 94 formed in the motor housing 44. The collar 92 and the integrally molded conduit 94 are preferably circular in cross-section such that the outside diameter of the collar 92 closely approximates the inside diameter of the integrally molded conduit 94 resulting in a tight, substantially air-tight fit of the collar 92 in the integrally molded conduit 94.

A plurality of wand members 96 are selectively mounted to the rear of the foot housing 16 and an upholstery brush 98 is selectively mounted in a C-shaped mount 100 extending from the rear of the contoured support member 84. In use, the collar 92 can be selectively withdrawn from the conduit 94 and one or more of the wand members 96 or brush 98 can be mounted to the collar 92 for cleaning drapes, upholstery and other surfaces not suitable for cleaning by an upright vacuum cleaner.

Figure 3:
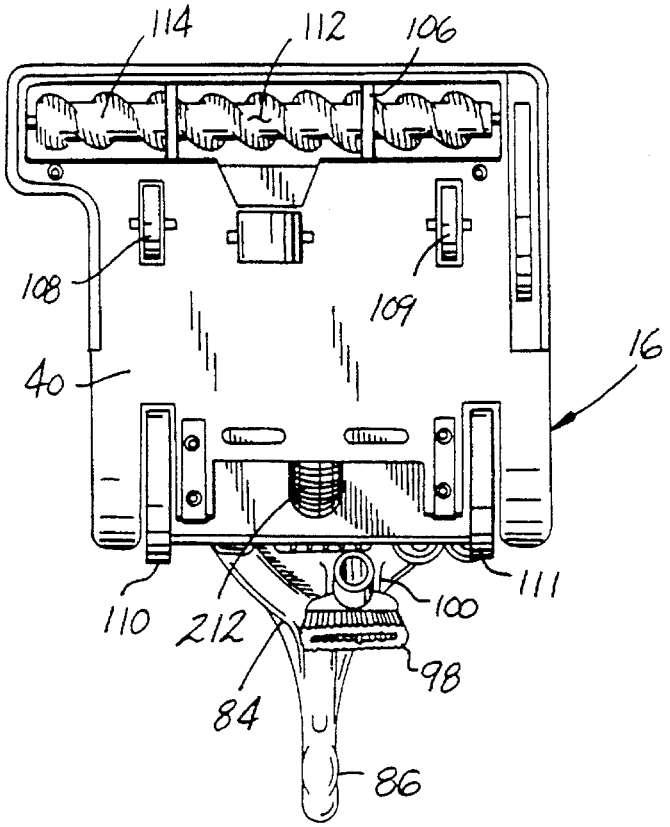
FIG. 3 is a bottom plan view of the multi-use vacuum of FIG. 1.

As seen in FIG. 3, the bottom surface 40 of the foot housing 16 has a sole plate 106 pivotally mounted thereto and front wheels 108, 109 and rear wheels 110, 111 extending downwardly therefrom. The sole plate 106 has a brush opening 112 formed therein and the bristles of a conventional agitation brush 114 extend outwardly through the brush opening 112 a short distance to engage the surface to be cleaned.

Figure 4:
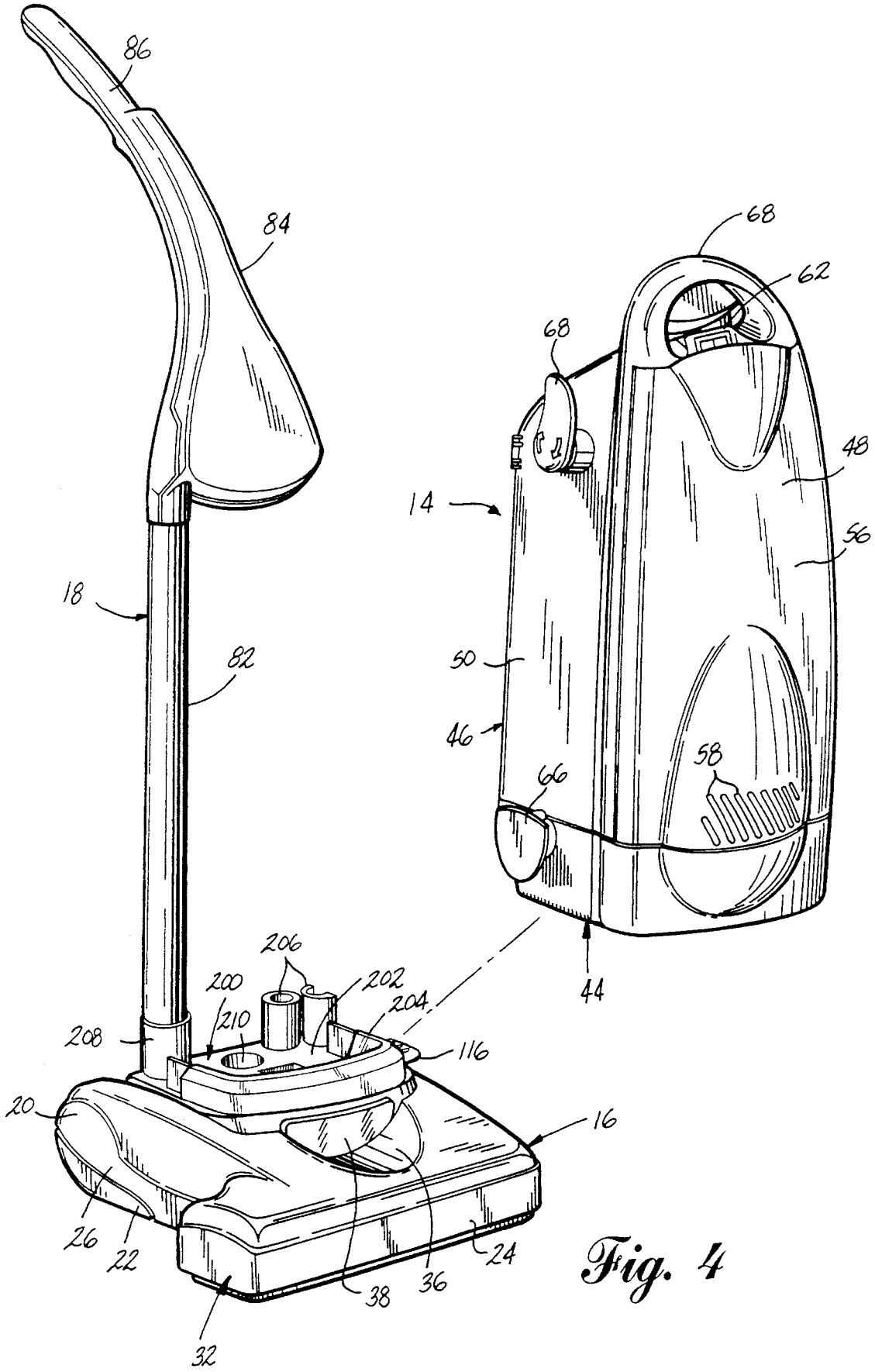
FIG. 4 is a perspective view of the vacuum module separated from the upright vacuum cleaner base.
Figure 6:
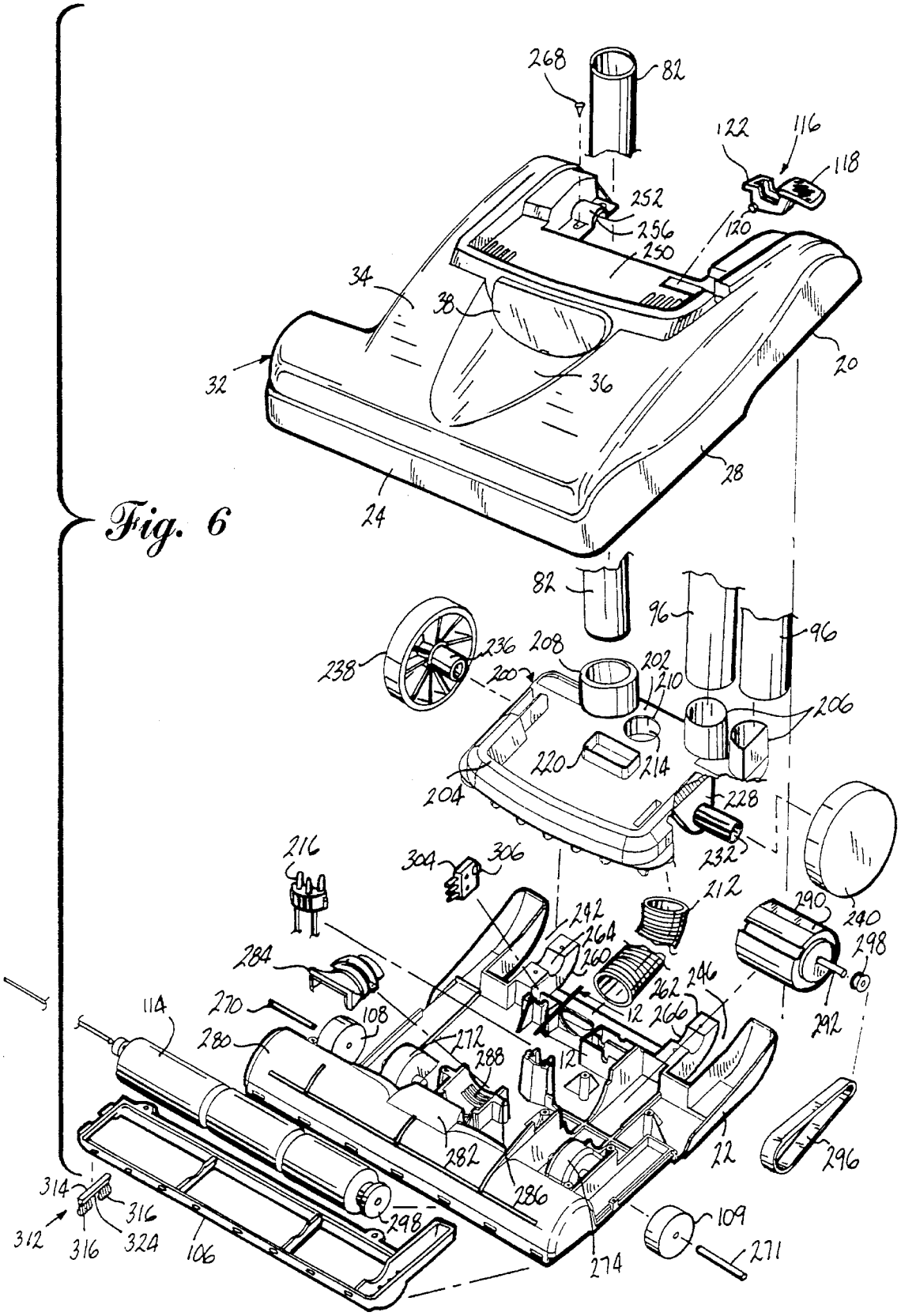
FIG. 6 is a exploded, perspective view of the foot housing.

As seen in FIG. 4, the module 14 is selectively mounted to the foot housing 16 and elongated support assembly 18. The module 14 is disengaged from the foot housing 16 by lifting of the module 14 relative to the foot housing 16. A L-shaped foot lever 116 is pivotally mounted in the foot housing 16. In use, the user presses down on the pedal portion 118 (FIG. 6) of the foot lever 116 causing the lever 116 to pivot about pivot pins 120 (FIG. 6). The downward force on the pedal portion 118 results in a lifting of the distal end 122 of the foot lever 116. The distal end 122 bears against the bottom surface of the module 14 and lifts the module 14 relative to the foot housing 16 and elongated support assembly 18.

With the vacuum module 14 detached from the foot housing 16 and elongated support assembly 18, the user can carry the module 14 and attach the wand members 96 and brushes 90 to the collar 92 for a wide variety of cleaning operations. As discussed in greater detail below, a latch mechanism 70 is mounted to the module 14 and tubular support member 82 for selectively interlocking the module 14 with the elongated support assembly 18.

Figure 5:
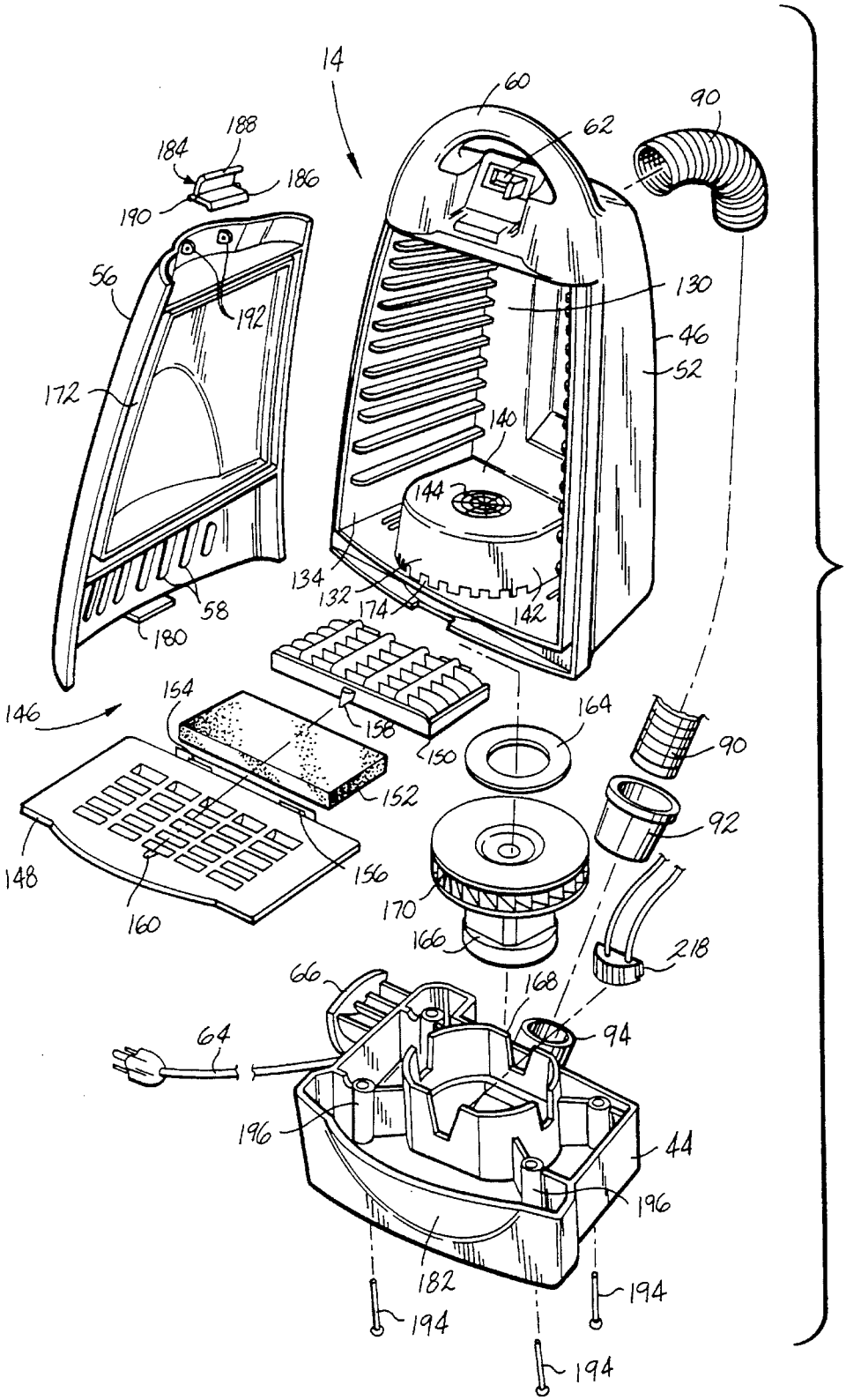
FIG. 5 is a exploded, perspective view of the vacuum module.
Figure 7:
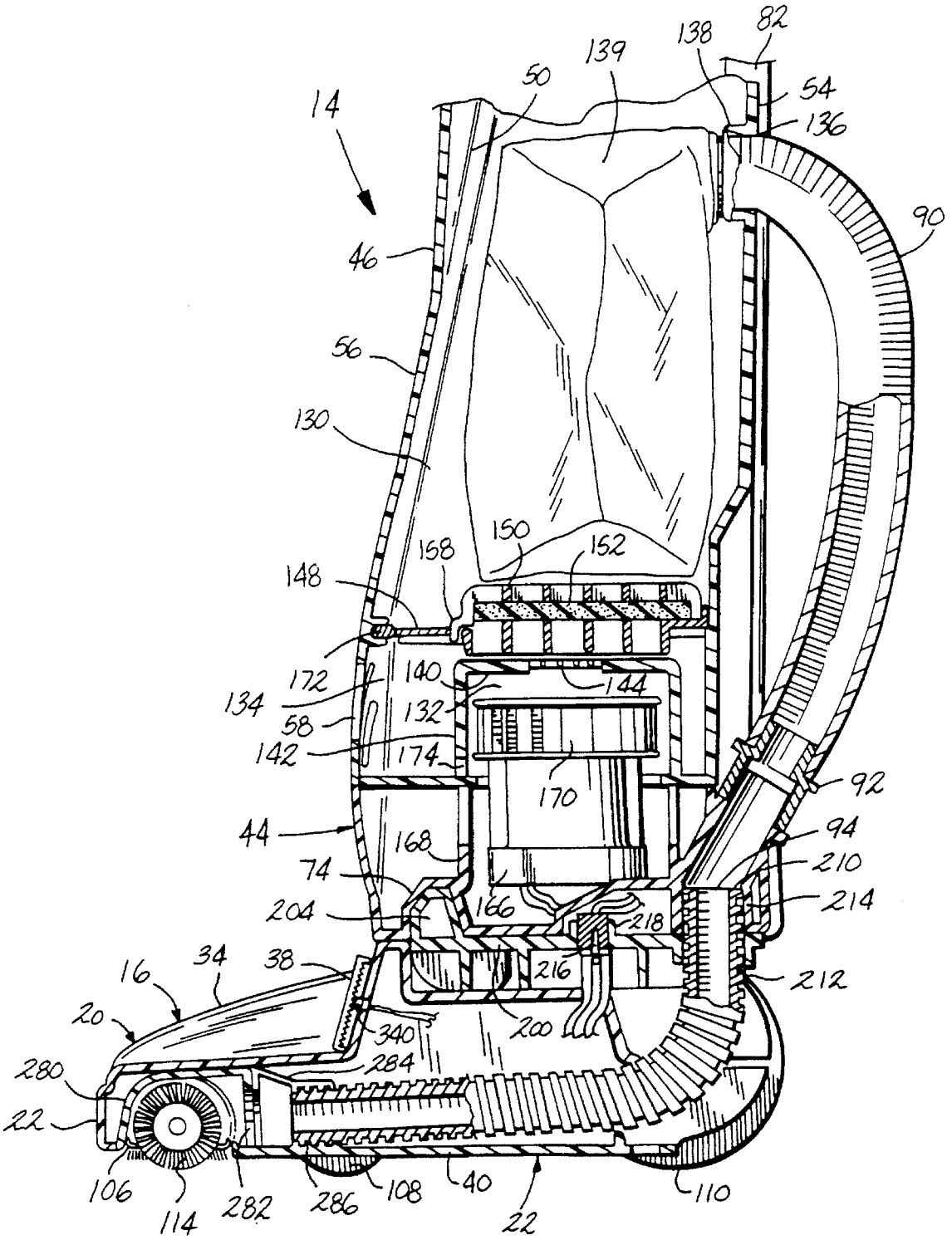
FIG. 7 is a partial sectional view of the vacuum module and foot housing taken along lines 7—7 of FIG. 1.

As seen in FIGS. 5 and 7, the bag housing 46 of the module 14 comprises a bag chamber 130, a fan chamber 132 and a exhaust chamber 134. An inlet 136 is formed at the top of the rear wall 54. A bag mounting projection 138 extends inwardly from the rear wall 54 and is adapted to receive a conventional vacuum filter bag 139 thereon.

The fan chamber 132 is defined by a top wall 140 and a U-shaped side wall 142 which extends outwardly from the rear wall 54. An outlet opening 144 is formed in the top wall 140 of the fan chamber 132. A filter assembly 146 is selectively mounted inside the bag chamber 130 and serves to separate the bag chamber 130 from the fan and exhaust chambers 132, 134. The filter assembly 146 comprises a lower grill member 148, an upper grill member 150 selectively mounted to the lower grill member and a filter 152 mounted between the lower and upper grill members 148, 150. The lower grill member 148 has a pair of grooves 154, 156 each of which receive a tongue extending rearwardly from the upper grill member 150. A locking tab 158 is formed on the front of the upper grill member and is selectively received in a locking slot 160.

The lower grill member 148 is mounted in the module 14 such that the lower grill member 148 separates the bag chamber 130 from the fan and exhaust chambers 132, 134.

An electric vacuum motor 166 is received in a motor mount 168 of the motor housing 44. A fan 170 mounted on top of the electric motor 166 is received in the fan chamber 132 of the bag housing 46. The electric motor 166 rotates the fan 170 to draw air from the bag chamber 130 through the outlet opening 144. The air removed from the bag chamber 130 is replaced by the flow of incoming air through the inlet 136. A rubber gasket 164 seals the fan 170 and the bottom surface of the top wall 140 of the fan chamber 132. An elastomeric seal 172 extends along the side and top edges of the access panel 56 and along the inside surface of the access panel corresponding to the front edge of the lower grill member 148. When the access panel 56 is mounted to the bag housing 46, the elastomeric seal 172 abuts the lower grill member 148 and the edges of the bag chamber 130, thereby creating a substantially air-tight seal except for the inlet 136 and outlet 144.

As air is withdrawn from the bag chamber 130 and passes through the filter 152, the air is drawn through the fan chamber 132 and enters the motor housing 44 and ultimately the exhaust chamber 134 through a plurality of exhaust openings 174 in the walls of the fan chamber. The air exits the exhaust chamber 134 through the exhaust vents 58 formed in the access panel 56.

The access panel 56 is selectively mounted to the module 14 by a downwardly extending tongue 180 which is received inside the front wall 182 of the motor housing 44 and a finger latch 184 pivotally mounted to the inside surface of the top of the access panel 56. The finger latch 184 has a hook or latching portion 186, a finger grip portion 188 and a pair of opposed pivot pins 190. The pivot pins are selectively received in pin mounts 192 integrally molded on the inside surface of the access panel 56. The hook portion 186 selectively engages the top edge of the bag housing 46 to selectively mount the access panel 56 to the module 14.

The motor housing 44 is securely mounted to the bag housing 46 by a plurality of conventional fasteners or screws 194 which extend upwardly from a plurality of bosses 196 of the motor housing to engage the bottom of the motor housing 44.

Figure 8:
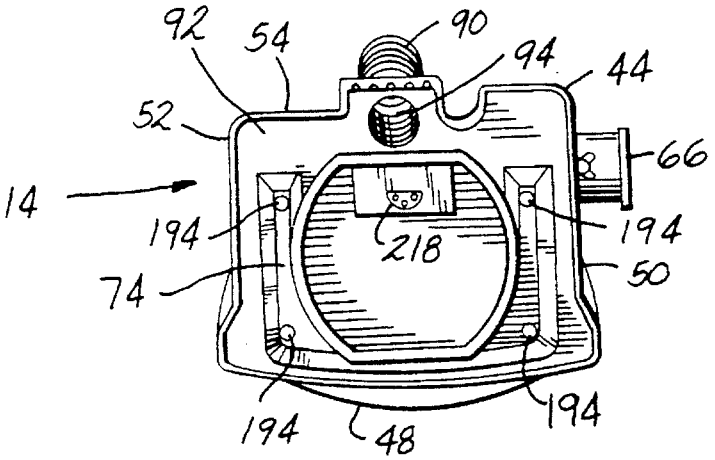
FIG. 8 is a bottom plan view of the vacuum module.

As seen in FIGS. 4, 6 and 8, the module 14 is selectively mounted to a base support member 200 which is in turn pivotally mounted to the foot housing 16. The base support member 200 comprises a top surface 202 and a U-shaped projection 204 extending upwardly from the top surface 202. The projection 204 is received in a complementary recess 74 (FIG. 8) formed on the bottom surface of the module 14.

Wand support projections 206 extend upwardly from the top surface at the rear of the base support member 200 and are adapted to be telescopically received inside the hollow wand members 96 (FIG. 2). A mount 208 for the tubular support member 82 also projects upwardly from the top surface 202 of the base support member 200. The bottom end of the tubular support member 82 is telescopically received inside the mount 208 and secured thereto by conventional fasteners (not shown). A vacuum hose opening 210 is also formed on the top surface 202 in a position such that when the module 14 is mounted to the base support member 200, the vacuum hose opening 210 abuts the opening of the conduit 94 on the bottom of the module 14. One end of a flexible vacuum hose 212 is mounted on a hose projection 214 which extends downwardly from the base support member 200.

The male connector 216 of an electrical connector 215 extends upwardly from the top surface 202 and are adapted to engage female connectors 218 (FIG. 8) mounted to the bottom surface of the module 14. The male connectors 216 are surrounded by an upwardly extending collar 220 which protects the male connectors 216 and assures proper alignment of the module 14 as it is received on the base support member 200.

A pair of axle flanges 226, 228 are spaced from one another and extend downwardly from the bottom surface of the base support member 200. A pair of tubular axle supports 230, 232 extend laterally outwardly from the flanges 226, 228. The axle supports 230, 232 are hollow and are adapted to telescopically receive and support axles 236 of the rear wheels 238, 240. When assembled, the rear wheels 238, 240 are received in wheel recesses 242, 246 formed in the rear of the lower housing member 22.

The upper surface 34 of the upper housing member 20 has a depression 250 formed therein which selectively receives the base support member 200. The rear portion of the upper housing member 20 is cut out to receive the downwardly extending axle flanges 226, 228. Immediately adjacent the cut out portion is a pair of upper support flanges 252, 254 which have laterally extending semi-circular recesses 256, 258 integrally molded therein.

The rear portion of the lower housing member 22 has a pair of lower support flanges 260, 262 which have semi-circular recesses 264, 266 formed therein. In the assembled condition, the upper and lower support flanges abut one another and the semi-circular recesses of the flanges define a circular pivot mounting for the laterally extending axle supports 230, 232 of the base support member 200. Conventional fasteners 268 securely mount the upper and lower support flanges to one another. With the upper and lower support flanges secured to one another and the axle supports 230, 232 received therein, the base support member 200 is pivotally mounted to the assembled foot housing 16.

As seen in FIG. 6, the front wheels 108, 109 are rotatably supported by axles 270, 271 in front wheel recesses 272, 274 formed in the lower housing member 22. As described earlier, a conventional brush 114 is rotatively mounted in a brush chamber 280 formed at the front of the lower housing member 22. The brush chamber 280 is open on the bottom thereof and has an outlet 282 at the rear thereof. The second end of the vacuum hose is securely mounted adjacent the outlet 282 through the cooperation of a transition member 284 and a base member 286. The second end of the corrugated vacuum hose 212 cooperates with a plurality of upwardly extending ribs 288 formed in the base member to prevent inadvertent removal of the vacuum hose from the assembled transition member 284 and base member 286. The transition member 284 is mounted on top of the base member 286 and encloses the second end of the vacuum hose 212 and completes the fluid conduit between the brush chamber outlet 282 and the vacuum hose 212.

Figure 11:
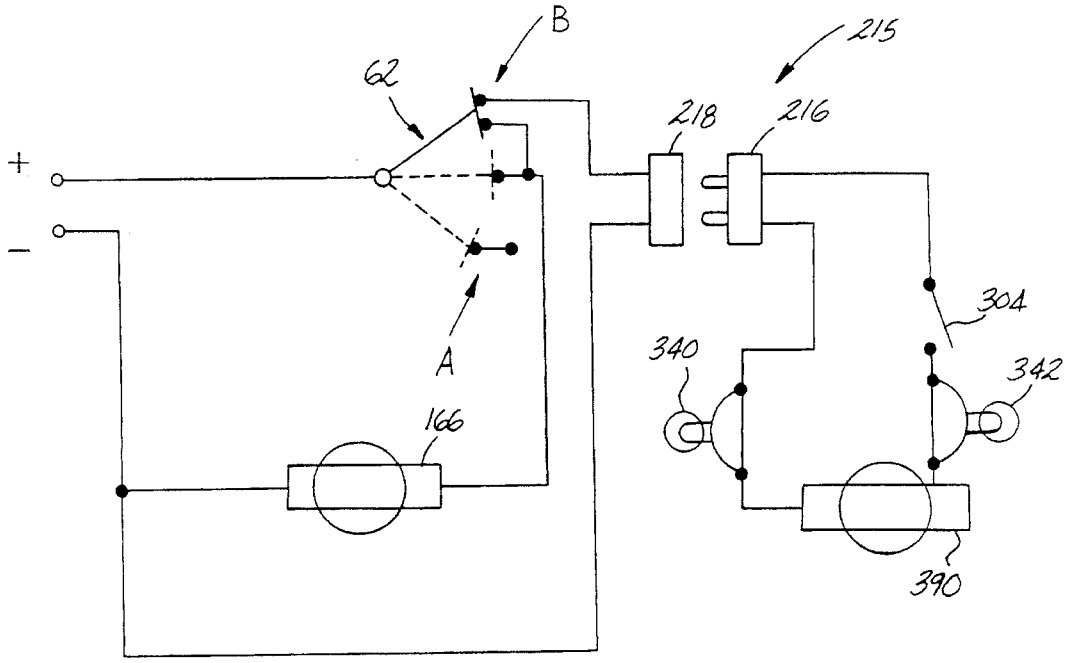
FIG. 11 is a schematic diagram of the electrical wiring of the multi-use vacuum according to the invention.

The brush motor 290 is securely mounted to the lower housing member 22 such that the outwardly extending drive shaft 292 and pulley 294 supported thereon are received around one end of the brush belt 296. The other end of the brush belt 296 is received on the pulley 298 of the brush 114. Electrical current for powering the brush motor 290 is supplied to the foot housing through the interconnection between the male and female connectors 216, 218 of the electrical connector 215 (FIG. 11).

Figure 12:
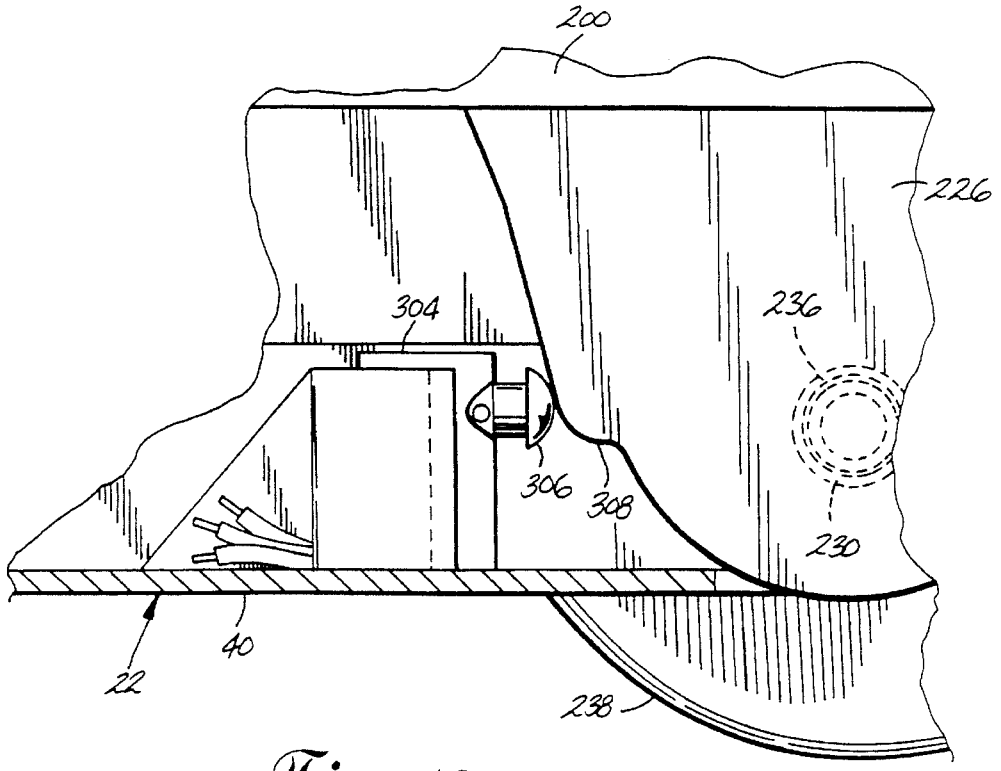
FIG. 12 is a detail sectional view of the foot housing showing the means for opening and closing the electrical circuit between the source of electricity and the brush motor.

When the module 14 is mounted to the base support member 200 and the electrical connector 215 is assembled, it is not always desirable to energize the brush motor 290 to rotate the brush 114. For example, when the elongated support assembly 18 is in the upright position and the user has removed the collar of the flexible hose 90 from the conduit 94 to clean draperies or the like, then it is undesirable to have continued rotation of the brush 114. As seen in FIGS. 6 and 12, a second electrical switch 304 is mounted in the lower housing member 22 and is adapted to open the electrical circuit between the brush motor 290 and the source of electricity when the elongated support assembly 18 is in the upright position. The second electrical switch 304 is mounted in the lower housing member 22 immediately adjacent one of the axle flanges 226 of the base support member 200. The second electrical switch 304 has a spring biased switch member 306 which is selectively engaged by an outwardly extending cam projection 308 formed on the axle flange 226. In the upright position, the cam projection 308 depresses the switch member 306 and opens the electrical circuit thereby preventing the supply of electrical current to the brush motor 290. As the elongated support assembly 18 and base support member 200 are pivoted out of the upright position, the cam projection 308 is rotated out of engagement with the spring biased switch member 306 which will extend outwardly. As the switch member 306 extends, electrical contacts (not shown) within the electrical switch 304 complete the electrical circuit to the brush motor 290 thereby resulting in rotation of the brush 114.

Figure 10:
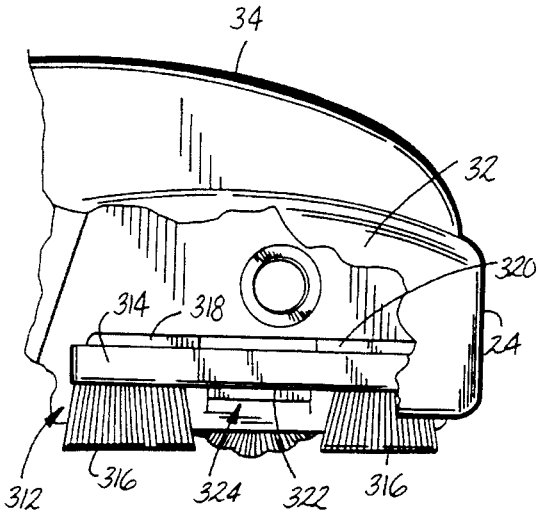
FIG. 10 is a side elevational view of the edge cleaning projection of the foot housing.

As seen in FIGS. 1, 6, and 10, an edge cleaning brush 312 is mounted to the side of the sole plate 106. The edge cleaning brush comprises a bristle support member 314 and a plurality of bristles 316 grouped adjacent the forward and rear edge of the support member 314 and defining an opening 324 therebetween. The bristle support member 314 is selectively received between a pair of upper support tabs 318, 320 and a lower support tab 322 extending laterally out of the side of the sole plate 106. The tabs 318, 320 and 322 are preferably formed of a resilient material and spaced such that the bristle support member 314 is snap-fit between the tabs.

The edge cleaning brush 312 is mounted to the outside edge of the edge cleaning projection 32 of the foot housing 16. As the edge cleaning projection 32 is maneuvered adjacent the corner between the wall and the carpeted surface being vacuumed, the resilient bristles 316 of the edge cleaning brush 312 will loosen and agitate dirt and dust in the corner such that the dirt and dust will be caught in the vacuum airflow passing through the opening 324 between the groupings of bristles 316.

Figure 9:
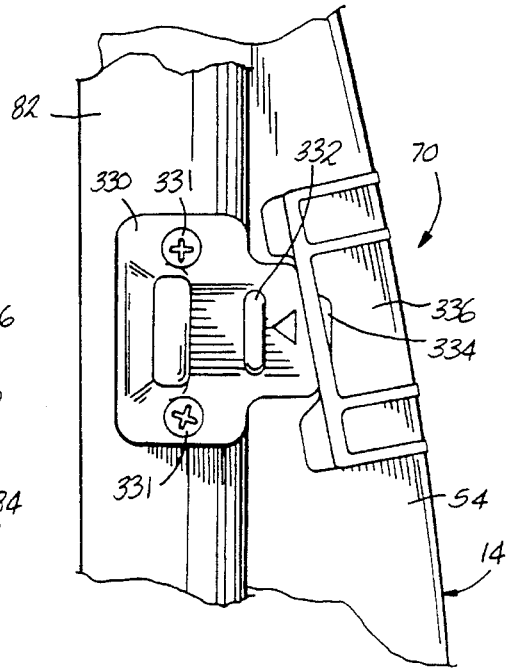
FIG. 9 is a detailed, rear elevational view of the vacuum module latch as seen in FIG. 2.

As seen in FIG. 9, the upper portion of the module 14 is selectively mounted to the tubular support member 82 by the latch mechanism 70. The latch mechanism comprises a latch housing 330 which is securely mounted to the tubular support member 82 by conventional fasteners 331. A latch member 332 is slidably mounted in the housing 330 for movement between an extended and a retracted position. A spring (not shown) mounted within the latch housing 330 biases the latch member in the extended position. The latch member 332 has an outwardly extending interlocking projection 334 which is selectively extended out of or retracted into the latch housing. A locking member 336 is mounted to the rear wall 54 of the module 14 in a position such that a slot formed in the locking member 336 will receive the interlocking projection 334 of the latch member 332 when the latch member 332 is in the extended position, thereby locking the module 14 to the elongated support assembly 18.

In use as an upright vacuum, the user moves the electrical switch 62 from the off position A to the vacuum and brush position B (FIG. 11). Therefore, electrical current is supplied to the electric vacuum motor 166 thereby creating a source of suction through the flexible hose 90, conduit 94, vacuum hose opening 210, vacuum 212 and brush chamber 280. When the user pivots the elongated support assembly 18 out of the upright position, the cam projection 308 will disengage the switch member to close the second electrical switch 304 thereby supplying electrical current to the brush motor 290 and to a pair of lights 340, 342 mounted in the foot housing 16 beneath the lens 38.

In order to use the wand members 96 or upholstery brush 98, the user pivots the elongated support assembly 18, base support member 200, and module 14 into the upright position causing the cam projection 308 to engage the switch member 306 to open the second electrical switch 304 and open the electrical circuit between the source of electricity and the brush motor 290. Next, the user removes the collar 92 from the conduit 94 of the motor housing 44 and mounts the desired wand members or cleaning tools to the collar for the particular cleaning operation desired. To resume use as an upright vacuum, the user merely replaces the collar 92 in the conduit 94 and pivots the elongated support member 18 and base support member 200 rearwardly.

The module 14 can be quickly and easily separated from the foot housing 16 and elongated support assembly 18 for use at unlimited distances from these elements. First, the user pivots the elongated support assembly 18 and base support member 200 into the upright position. Then, the user grasps the arcuate handle 60 and lifts upwardly while depressing the foot lever 116. The module 14 separates from the base support member 200 and the male and female connectors 216, 218 of the electrical connector 215 are separated from one another. Now, the module 14 can be carried outside for cleaning the interior of a car or carried up the stairs for cleaning stairs. The module 14 is relatively lightweight and compact and can be easily carried about for a variety of applications.

A multi-use vacuum according to the invention provides an unlimited number of applications for what appears to be a conventional upright vacuum. The module is compact and lightweight thereby simplifying the use of the module.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. A vacuum cleaner comprising:

a foot housing;

a base pivotally mounted to said foot housing;

an elongated support member non-removably mounted at a lower portion to the base during typical use of the vacuum cleaner, the elongated support member being adapted for use in pushing and pulling the base and the foot housing along the floor;

a portable cleaning module comprising;

a module housing;

a bag supported in the module housing for collecting dust and dirt;

a conduit for conveying the collected dust and dirt from the foot housing to the bag, the conduit having a first end connected to the bag and a second end removably connected to the base member; and a motor-driven fan supported in the module housing for creating suction within the conduit through the bag to convey collected dust and dirt to the bag;

the module mounting the bag, conduit and motor-driven fan so that the bag, conduit and motor-driven fan are connected together as a unit, the module being selectively and removably mounted to the base at least through a mechanical interconnection so that the module can be separated from the foot housing, base and elongated support member and be operated as a portable vacuum cleaner and the module further is closely adjacent the elongated support member, extends upwardly along at least a portion of the length of the elongated support member and is adapted to pivot with the base and elongated support member relative the foot housing when the module is mounted to the base; and the interconnection between the module and the base comprising a male projection formed on one of the base member and the module housing, a female recess formed on the other of the base member and the module housing, a first electrical connector formed on one of the base and module housing and a second electrical connector formed on the other of the base and module housing, the first and second electrical connectors being selectively engaged to supply electrical current from the module to the foot housing when the module housing is mounted to the base;

whereby the module can be operated as a portable vacuum cleaner independently of and separate from the foot housing, base and elongated support member when the module is separated from the base and the vacuum cleaner can be operated as an upright vacuum cleaner when the module is mounted to the base.

2. A vacuum cleaner according to claim 1 and further comprising a latch mechanism mounted to the module and the elongated support mechanism to selectively interlock the module and elongated support mechanism.

3. A vacuum cleaner according to claim 1 and further comprising a switch mounted to one of the base and the support member, the switch having first and second operable positions, wherein the switch is adapted to assume the first position when the support member is in a fully upright position relative to the foot housing and the switch is adapted to assume the second position when the support member is in a position other than the fully upright position relative to the foot housing, wherein in the first position, the switch prevents the flow of electrical current to an agitation motor mounted in the foot housing and in the second position, the switch completes an electrical circuit to supply electrical current to the agitation motor.

4. A vacuum cleaner according to claim 1 and further comprising a handle mounted to the top of the portable cleaning module, the handle being adapted to be grasped by the user when the portable cleaning module is separated from the base, foot housing and elongated support member.

5. A vacuum cleaner according to claim 1 and further comprising at least one accessory mounting projection formed on the base for storing accessory cleaning tools.

6. A vacuum cleaner according to claim 1 and further comprising an electrical cord electrically connected to the module, the cord supplying all of the electrical current necessary to operate the vacuum cleaner as an upright vacuum cleaner or to operate the module independently of the floor suction component and support member.

7. A vacuum cleaner according to claim 1 wherein the foot housing has a vacuum nozzle mounted therein in fluid communication with the motor driven fan and further comprising an edge cleaning brush mounted immediately adjacent the vacuum nozzle, the edge cleaning brush having a plurality of bristles fixedly mounted and extending downwardly therefrom and an airflow passageway extending between the vacuum nozzle and the exterior of the foot housing, the airflow passageway being formed immediately adjacent the bristles so that dirt and dust dislodged by the bristles of the brush are pulled into the vacuum nozzle through the airflow passageway as a result of the negative air pressure in the vacuum nozzle created by the motor driven fan.

8. A vacuum cleaner according to claim 1 and further comprising a three position electrical switch mounted to the module, the electrical switch being electrically connected to a source of electricity and a vacuum motor mounted to the motor-driven fan and an agitation motor mounted to an agitation member, wherein in the first position, an open electrical circuit is created between the source of electricity and the vacuum motor and the agitation motor, in a second position, a closed electrical circuit is created between the vacuum motor and the source of electricity and an open electrical circuit exists between the source of electricity and the agitation motor and in the third position closed circuits are created between the source of electricity and the vacuum motor and agitation motor.

9. A vacuum cleaner according to claim 1 wherein the base further comprises at least one cylindrical support member and the foot housing comprises at least one cylindrical support mounting, the at least one cylindrical support member being rotatively received in the at least one cylindrical support mounting.

10. A vacuum cleaner according to claim 9 wherein the at least one cylindrical support member comprises a wheel axle support mounting adapted to rotatively receive an axle from a wheel supporting the foot housing.

11. A vacuum cleaner according to claim 10 wherein the foot housing comprises an upper housing member and a lower housing member selectively mounted to one another, and the at least one cylindrical support mounting being defined by a semi-circular recess formed in each of the upper and lower housing members.

12. A vacuum cleaner according to claim 1 and further comprising a lever arm pivotally mounted to the foot housing having a first lever arm adapted to engage a bottom surface of the module and a second lever arm extending outwardly from the foot housing, whereby the lever arm assists in the removal of the module from the base member by depressing the second lever arm.

13. A vacuum cleaner comprising:

a foot housing;

a base pivotally mounted to said foot housing;

an elongated support member non-removably mounted at a lower portion to the base during typical use of the vacuum cleaner, the elongated support member being adapted for use in pushing and pulling the base and the foot housing along the floor;

a portable cleaning module comprising;

a module housing;

a bag supported in the module housing for collecting dust and dirt;

a conduit for conveying the collected dust and dirt from the foot housing to the bag, the conduit having a first end connected to the bag and a second end removably connected to the base member; and a motor-driven fan supported in the module housing for creating suction within the conduit through the bag to convey collected dust and dirt to the bag;

the module mounting the bag, conduit and motor-driven fan so that the bag, conduit and motor-driven fan are connected together as a unit, the module being selectively and removably mounted to the base at least through a mechanical interconnection so that the module can be separated from the foot housing, base and elongated support member and be operated as a portable vacuum cleaner and the module further is closely adjacent the elongated support member, extends upwardly along at least a portion of the length of the elongated support member and is adapted to pivot with the base and elongated support member relative the foot housing when the module is mounted to the base; and a switch mounted to one of the base and the support member, the switch having first and second operable positions, wherein the switch is adapted to assume the first position when the support member is in a fully upright position relative to the foot housing and the switch is adapted to assume the second position when the support member is in a position other than the fully upright position relative to the foot housing, wherein in the first position, the switch prevents the flow of electrical current to an agitation motor mounted in the foot housing and in the second position, the switch completes an electrical circuit to supply electrical current to the agitation motor;

whereby the module can be operated as a portable vacuum cleaner independently of and separate from the foot housing, base and elongated support member when the module is separated from the base and the vacuum.

14. A vacuum cleaner according to claim 13 wherein the interconnection between the module housing and the base comprises a male projection formed on one of the base member and the module housing and a female recess formed on the other of the base member and the module housing.

15. A vacuum cleaner according to claim 14 wherein the interconnection between the module housing and the base further comprises a first electrical connector formed on one of the base and module housing and a second electrical connector formed on the other of the base and module housing, the first and second electrical connectors being selectively engaged to supply electrical current from the module to the foot housing when the module housing is mounted to the base.

16. A vacuum cleaner according to claim 15 and further comprising a latch mechanism mounted to the module and the elongated support mechanism to selectively interlock the module and elongated support mechanism.

17. A vacuum cleaner according to claim 15 and further comprising an electrical cord electrically connected to the module, the cord supplying all of the electrical current necessary to operate the vacuum cleaner as an upright vacuum cleaner or to operate the module independently of the floor suction component and support member.

18. A vacuum cleaner according to claim 15 and further comprising a three position electrical switch mounted to the module, the electrical switch being electrically connected to a source of electricity and a vacuum motor mounted to the motor-driven fan and an agitation motor mounted to an agitation member, wherein in the first position, an open electrical circuit is created between the source of electricity and the vacuum motor and the agitation motor, in a second position, a closed electrical circuit is created between the vacuum motor and the source of electricity and an open electrical circuit exists between the source of electricity and the agitation motor and in the third position closed circuits are created between the source of electricity and the vacuum motor and agitation motor.

19. A vacuum cleaner comprising:

a foot housing;

a base pivotally mounted to said foot housing;

at least one accessory mounting projection formed on the base for storing accessory cleaning tools;

an elongated support member non-removably mounted at a lower portion to the base during typical use of the vacuum cleaner, the elongated support member being adapted for use in pushing and pulling the base and the foot housing along the floor;

a portable cleaning module comprising;

a module housing;

a bag supported in the module housing for collecting dust and dirt;

a conduit for conveying the collected dust and dirt from the foot housing to the bag, the conduit having a first end connected to the bag and a second end removably connected to the base member; and a motor-driven fan supported in the module housing for creating suction within the conduit through the bag to convey collected dust and dirt to the bag;

the module mounting the bag, conduit and motor-driven fan so that the bag, conduit and motor-driven fan are connected together as a unit, the module being selectively and removably mounted to the base at least through a mechanical interconnection so that the module can be separated from the foot housing, base and elongated support member and be operated as a portable vacuum cleaner and the module further is closely adjacent the elongated support member, extends upwardly along at least a portion of the length of the elongated support member and is adapted to pivot with the base and elongated support member relative the foot housing when the module is mounted to the base;

whereby the module can be operated as a portable vacuum cleaner independently of and separate from the foot housing, base and elongated support member when the module is separated from the base and the vacuum cleaner can be operated as an upright vacuum cleaner when the module is mounted to the base.

20. A vacuum cleaner according to claim 19 and further comprising a latch mechanism mounted to the module and the elongated support mechanism to selectively interlock the module and elongated support mechanism.

21. A vacuum cleaner according to claim 19 wherein the interconnection between the module housing and the base comprises a male projection formed on one of the base member and the module housing and a female recess formed on the other of the base member and the module housing.

22. A vacuum cleaner according to claim 19 and further comprising a handle mounted to the top of the portable cleaning module, the handle being adapted to be grasped by the user when the portable cleaning module is separated from the base, foot housing and elongated support member.

23. A vacuum cleaner comprising:

a foot housing;

a base pivotally mounted to said foot housing;

an elongated support member non-removably mounted at a lower portion to the base during typical use of the vacuum cleaner, the elongated support member being adapted for use in pushing and pulling the base and the foot housing along the floor;

a portable cleaning module comprising;

a module housing;

a bag supported in the module housing for collecting dust and dirt;

a conduit for conveying the collected dust and dirt from the foot housing to the bag, the conduit having a first end connected to the bag and a second end removably connected to the base member;

a motor-driven fan supported in the module housing for creating suction within the conduit through the bag to convey collected dust and dirt to the bag; and a three position electrical switch mounted to the module, the electrical switch being electrically connected to a source of electricity and a vacuum motor mounted to the motor-driven fan and an agitation motor mounted to an agitation member, wherein in the first position, an open electrical circuit is created between the source of electricity and the vacuum motor and the agitation motor, in a second position, a closed electrical circuit is created between the vacuum motor and the source of electricity and an open electrical circuit exists between the source of electricity and the agitation motor and in the third position closed circuits are created between the source of electricity and the vacuum motor and agitation motor the module mounting the bag, conduit and motor-driven fan so that the bag, conduit and motor-driven fan are connected together as a unit, the module being selectively and removably mounted to the base at least through a mechanical interconnection so that the module can be separated from the foot housing, base and elongated support member and be operated as a portable vacuum cleaner and the module further is closely adjacent the elongated support member, extends upwardly along at least a portion of the length of the elongated support member and is adapted to pivot with the base and elongated support member relative the foot housing when the module is mounted to the base;

whereby the module can be operated as a portable vacuum cleaner independently of and separate from the foot housing, base and elongated support member when the module is separated from the base and the vacuum cleaner can be operated as an upright vacuum cleaner when the module is mounted to the base.

24. A vacuum cleaner according to claim 23 and further comprising a latch mechanism mounted to the module and the elongated support mechanism to selectively interlock the module and elongated support mechanism.

25. A vacuum cleaner according to claim 23 and further comprising an electrical cord electrically connected to the module, the cord supplying all of the electrical current necessary to operate the vacuum cleaner as an upright vacuum cleaner or to operate the module independently of the floor suction component and support member.

26. A vacuum cleaner according to claim 23 and further comprising a lever arm pivotally mounted to the foot housing having a first lever arm adapted to engage a bottom surface of the module and a second lever arm extending outwardly from the foot housing, whereby the lever arm assists in the removal of the module from the base member by depressing the second lever arm.

27. A vacuum cleaner according to claim 23 and further comprising a switch mounted to one of the base and the support member, the switch having first and second operable positions, wherein the switch is adapted to assume the first position when the support member is in a fully upright position relative to the foot housing and the switch is adapted to assume the second position when the support member is in a position other than the fully upright position relative to the foot housing, wherein in the first position, the switch prevents the flow of electrical current to an agitation motor mounted in the foot housing and in the second position, the switch completes an electrical circuit to supply electrical current to the agitation motor.

28. A vacuum cleaner comprising:

a foot housing having at least one cylindrical support mounting;

a base having at least one cylindrical wheel axle support mounting adapted to be rotatively received in the at least one cylindrical support mounting of the foot for pivotally mounting the base to the foot, the at least one cylindrical wheel axle support mounting being adapted to rotatively receive an axle from a wheel supporting the foot housing;

an elongated support member non-removably mounted at a lower portion to the base during typical use of the vacuum cleaner, the elongated support member being adapted for use in pushing and pulling the base and the foot housing along the floor;

a portable cleaning module comprising;

a module housing;

a bag supported in the module housing for collecting dust and dirt;

a conduit for conveying the collected dust and dirt from the foot housing to the bag, the conduit having a first end connected to the bag and a second end removably connected to the base member; and a motor-driven fan supported in the module housing for creating suction within the conduit through the bag to convey collected dust and dirt to the bag;

the module mounting the bag, conduit and motor-driven fan so that the bag, conduit and motor-driven fan are connected together as a unit, the module being selectively and removably mounted to the base at least through a mechanical interconnection so that the module can be separated from the foot housing, base and elongated support member and be operated as a portable vacuum cleaner and the module further is closely adjacent the elongated support member, extends upwardly along at least a portion of the length of the elongated support member and is adapted to pivot with the base and elongated support member relative the foot housing when the module is mounted to the base;

whereby the module can be operated as a portable vacuum cleaner independently of and separate from the foot housing, base and elongated support member when the module is separated from the base and the vacuum cleaner can be operated as an upright vacuum cleaner when the module is mounted to the base.

29. A vacuum cleaner according to claim 28 and further comprising a switch mounted to one of the base and the support member, the switch having first and second operable positions, wherein the switch is adapted to assume the first position when the support member is in a fully upright position relative to the foot housing and the switch is adapted to assume the second position when the support member is in a position other than the fully upright position relative to the foot housing, wherein in the first position, the switch prevents the flow of electrical current to an agitation motor mounted in the foot housing and in the second position, the switch completes an electrical circuit to supply electrical current to the agitation motor.

30. A vacuum cleaner according to claim 28 and further comprising a three position electrical switch mounted to the module, the electrical switch being electrically connected to a source of electricity and a vacuum motor mounted to the motor-driven fan and an agitation motor mounted to an agitation member, wherein in the first position, an open electrical circuit is created between the source of electricity and the vacuum motor and the agitation motor, in a second position, a closed electrical circuit is created between the vacuum motor and the source of electricity and an open electrical circuit exists between the source of electricity and the agitation motor and in the third position closed circuits are created between the source of electricity and the vacuum motor and agitation motor.

31. A vacuum cleaner comprising:

a foot housing;

a base pivotally mounted to said foot housing;

an elongated support member non-removably mounted at a lower portion to the base during typical use of the vacuum cleaner, the elongated support member being adapted for use in pushing and pulling the base and the foot housing along the floor;

a portable cleaning module comprising;

a module housing;

a bag supported in the module housing for collecting dust and dirt;

a conduit for conveying the collected dust and dirt from the foot housing to the bag, the conduit having a first end connected to the bag and a second end removably connected to the base member; and a motor-driven fan supported in the module housing for creating suction within the conduit through the bag to convey collected dust and dirt to the bag;

the module mounting the bag, conduit and motor-driven fan so that the bag, conduit and motor-driven fan are connected together as a unit, the module being selectively and removably mounted to the base at least through a mechanical interconnection so that the module can be separated from the foot housing, base and elongated support member and be operated as a portable vacuum cleaner and the module further is closely adjacent the elongated support member, extends upwardly along at least a portion of the length of the elongated support member and is adapted to pivot with the base and elongated support member relative the foot housing when the module is mounted to the base; and a lever arm pivotally mounted to the foot housing having a first lever arm portion adapted to engage a bottom surface of the module and a second lever arm portion extending outwardly from the foot housing, wherein depressing the second portion of the lever arm assists in the removal of the module from the base member;

whereby the module can be operated as a portable vacuum cleaner independently of and separate from the foot housing, base and elongated support member when the module is separated from the base and the vacuum cleaner can be operated as an upright vacuum cleaner when the module is mounted to the base.

32. A vacuum cleaner according to claim 31 and further comprising a latch mechanism mounted to the module and the elongated support mechanism to selectively interlock the module and elongated support mechanism.

33. A vacuum cleaner according to claim 31 and further comprising a handle mounted to the top of the portable cleaning module, the handle being adapted to be grasped by the user when the portable cleaning module is separated from the base, foot housing and elongated support member.

34. A vacuum cleaner according to claim 31 and further comprising at least one accessory mounting projection formed on the base for storing accessory cleaning tools.

35. A vacuum cleaner comprising:

a foot housing;

a base pivotally mounted to said foot housing;

an elongated support member non-removably mounted at a lower portion to the base during typical use of the vacuum cleaner, the elongated support member being adapted for use in pushing and pulling the base and the foot housing along the floor;

a portable cleaning module comprising;

a module housing;

a bag supported in the module housing for collecting dust and dirt;

a flexible hose conduit provided on the module for conveying the collected dust and dirt to the bag, the conduit having a first end connected to the bag and a second end removably connected to the base member so that the flexible hose comprises at least a portion of the working air conduit to the bag when the module is mounted to the base and when the module is removed from the base; and a motor-driven fan supported in the module housing for creating suction within the conduit through the bag to convey collected dust and dirt to the bag; and the module mounting the bag, conduit and motor-driven fan so that the bag, conduit and motor-driven fan are connected together as a unit, the module being selectively and removably mounted to the base at least through a mechanical interconnection so that the module can be separated from the foot housing, base and elongated support member and be operated as a portable vacuum cleaner and the module further is closely adjacent the elongated support member, extends upwardly along at least a portion of the length of the elongated support member and is adapted to pivot with the base and elongated support member relative the foot housing when the module is mounted to the base;

whereby the module and flexible hose conduit can be operated as a portable vacuum cleaner independently of and separate from the foot housing, base and elongated support member when the module is separated from the base and the vacuum cleaner can be operated as an upright vacuum cleaner when the module and flexible hose conduit are mounted to the base.

36. A vacuum cleaner comprising:

a foot housing;

a base pivotally mounted to said foot housing;

an elongated support member non-removably mounted at a lower portion to the base during typical use of the vacuum cleaner, the elongated support member being adapted for use in pushing and pulling the base and the foot housing along the floor;

a portable cleaning module comprising;

a module housing;

a bag supported in the module housing for collecting dust and dirt;

a conduit for conveying the collected dust and dirt from the foot housing to the bag, the conduit having a first end connected to the bag and a second end removably connected to the base member; and a motor-driven fan supported in the module housing for creating suction within the conduit through the bag to convey collected dust and dirt to the bag;

the module mounting the bag, conduit and motor-driven fan so that the bag, conduit and motor-driven fan are connected together as a unit, the module being selectively and removably mounted to the base at least through a mechanical interconnection so that the module can be separated from the foot housing, base and elongated support member and be operated as a portable vacuum cleaner and the module further is closely adjacent the elongated support member, extends upwardly along at least a portion of the length of the elongated support member and is adapted to pivot with the base and elongated support member relative the foot housing when the module is mounted to the base; and a latch assembly comprising a first latch member provided on the elongated support member and a second latch member provided on the module, the latch assembly being adapted to selectively lock the module to the elongated support member;

whereby the module and flexible hose conduit can be operated as a portable vacuum cleaner independently of and separate from the foot housing, base and elongated support member when the module is separated from the base and the vacuum cleaner can be operated as an upright vacuum cleaner when the module and flexible hose conduit are mounted to the base.

* * * * *

UNITED STATES PATENT AND TRADEMARK OFFICE

CERTIFICATE OF CORRECTION

PATENT NO. : 5,524,321

DATED : June 11, 1996

INVENTOR(S) : James M. Weaver et al.

It is certified that error appears in the above-indentified patent and that said Letters Patent is hereby corrected as shown below:

Column 11, line 21, claim 16:
"15" should be --13--.

Column 11, line 25, claim 17:
"15" should be --13--.

Column 11, line 31, claim 18:
"15" should be --13--.

Signed and Sealed this

Twenty-seventh Day of August, 1996

Bruce Lehman

*Attest:*

BRUCE LEHMAN

*Attesting Officer*

*Commissioner of Patents and Trademarks*